United States Patent [19]

Okamoto et al.

[11] Patent Number: 4,469,429

[45] Date of Patent: Sep. 4, 1984

[54] ELECTROPHOTOGRAPHIC REPRODUCING MACHINE

[75] Inventors: Yukio Okamoto; Noriyoshi Tarumi; Hisashi Ashida, all of Hachioji, Japan

[73] Assignee: Konishiroku Photo Industry Co., Ltd., Tokyo, Japan

[21] Appl. No.: 411,572

[22] Filed: Aug. 25, 1982

[30] Foreign Application Priority Data

Sep. 2, 1981 [JP] Japan ..... 56-137047

[51] Int. Cl.[3] ..... G03G 13/09; G03G 15/00

[52] U.S. Cl. ..... 355/3 DD; 118/647

[58] Field of Search ..... 355/3 DD, 15, 16, 3 CH, 355/3 R, 3 DR; 118/647, 651, 657, 658

[56] References Cited

U.S. PATENT DOCUMENTS

| | | | |
|---|---|---|---|
| Re. 30,477 | 1/1981 | Gardiner et al. | 118/647 X |
| 2,839,400 | 6/1958 | Montcrieff-Yeates | 118/647 X |
| 3,941,472 | 3/1976 | Nagahara et al. | 355/3 DD X |
| 3,950,089 | 4/1976 | Fraser et al. | 355/3 DD |
| 3,981,268 | 9/1976 | Tsukamoto et al. | 355/3 DD X |
| 4,153,364 | 5/1979 | Suzuki et al. | 118/647 X |
| 4,168,329 | 9/1979 | Miyakawa et al. | 118/647 X |
| 4,194,828 | 3/1980 | Hölz et al. | 118/647 X |
| 4,200,391 | 4/1980 | Sakamoto et al. | 118/647 X |
| 4,247,195 | 1/1981 | Okamoto et al. | 118/647 X |
| 4,256,401 | 3/1981 | Fujimura et al. | 118/647 X |
| 4,314,755 | 2/1982 | Kinashi | 118/647 X |
| 4,352,553 | 10/1982 | Hirahara | 118/647 X |
| 4,376,813 | 3/1983 | Yuge et al. | 118/647 X |

*Primary Examiner*—J. V. Truhe
*Assistant Examiner*—Terry Flower
*Attorney, Agent, or Firm*—Jordan B. Bierman; Linda Bierman

[57] ABSTRACT

An electrophotographic reproducing machine in which the bias voltage applied to the sleeve is set at such a level as to substantially nullify the developing current which is produced as a result of induction of charge in the developer in accordance with the potential of the electrostatic latent image when the document is a blank. The setting of the bias voltage is made in accordance with an electrostatic latent image formed as a result of the projection of a leading projecting portion provided on a document glass plate in contact with the document mounting position, the projection of the leading projecting portion being made in advance to the projection of the image on the document to form the electrostatic latent image of a potential substantially equal to that corresponding to the blank portion of the document.

7 Claims, 6 Drawing Figures

ELECTROPHOTOGRAPHIC REPRODUCING MACHINE

BACKGROUND OF THE INVENTION

1. Field of the Invention

The present invention relates to an improvement in an electrophotographic reproducing machine and, more particularly, to an improvement of an electrophotographic reproducing machine (referred to simply as "reproducing machine", hereinunder) of the type in which an electrostatic latent image is formed by projecting a document image on a charged photosensitive member and the latent image is developed by supplying a conductive or insulated developer to the surface of the photosensitive member by means of a developer carrying means capable of being applied with a biasing voltage.

2. Description of the Prior Art

FIG. 1 shows a known reproducing machine of the type mentioned above, in which a sleeve 2 as the developer carrying means of the developing device is held at the grounding potential, while FIG. 2 shows another known reproducing machine of the type in which the sleeve 2 is held at a constant potential. In the reproducing machine shown in FIG. 1, a relationship as shown in FIG. 3 is observed between the surface potential of the photosensitive member 3 and the amount of deposition of the developer, provided that the photosensitive member 3 is made of selenium. More specifically, the surface potential at which the developer starts to attach to the photosensitive member 3 is 50 to 100 V. Therefore, if the potential of the portion of the photosensitive member 3 corresponding to the white blank portion of the document exceeds above-mentioned potential, the developer undesirably attaches also to the background portion of the picture. This phenomenon is usually referred to as "fog". In order to eliminate the fog, in the reproducing machine of the type shown in FIG. 2, a biasing voltage of several tens of volts of the same potential and polarity as the surface of the photosensitive member 3 is applied to the sleeve 2. The potential of the electrostatic latent image, including the portion corresponding to the white blank of the document, tends to fluctuate due to various reasons such as fatigue as a result of continuous reproduction, change in the ambient air temperature and so forth. In consequence, the generation of fog cannot be avoided perfectly even in the reproducing machine shown in FIG. 2. Such a reproducing machine also has been known as adapted to vary the level of the biasing voltage applied to the sleeve upon sensing the change of the surface potential of the photosensitive member 3. This improved reproducing machine, however, necessitates a sensor for sensing the surface potential of the photosensitive member 3 and a complicated circuit for controlling the biasing voltage.

SUMMARY OF THE INVENTION

Accordingly, it is a primary object of the invention to provide a reproducing machine capable of stably producing a clear picture while avoiding fogging regardless of the fatigue after continuous reproduction and/or change in the ambient air temperature without requiring any sensor for sensing the surface potential of the photosensitive member.

To this end, according to the invention, there is provided a reproducing machine in which the biasing voltage applied to the sleeve is set at such a level as to substantially nullify the developing current which is produced as a result of induction of charge in the developer in accordance with the potential of the electrostatic latent image when the document is a white blank one having no visible image.

The above and other objects, features and advantages of the invention will become clear from the following description of the preferred embodiments taken in conjunction with the accompanying drawings.

DESCRIPTION OF THE PREFERRED EMBODIMENTS

Figure 1:
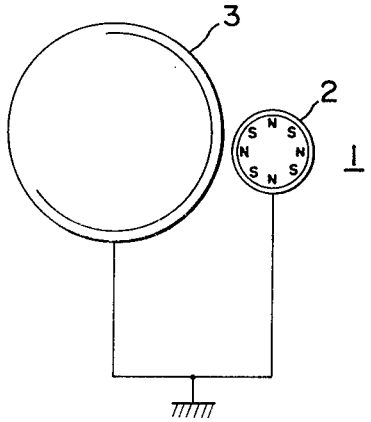
FIG. 1 PRIOR ART
FIGS. 1 and 2 schematically show essential parts of reproducing machines of the prior art.
Figure 2:
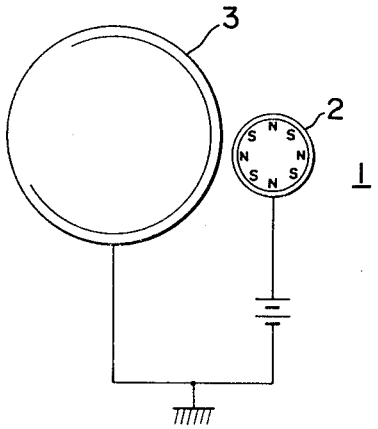
FIG. 2 PRIOR ART
Figure 3:
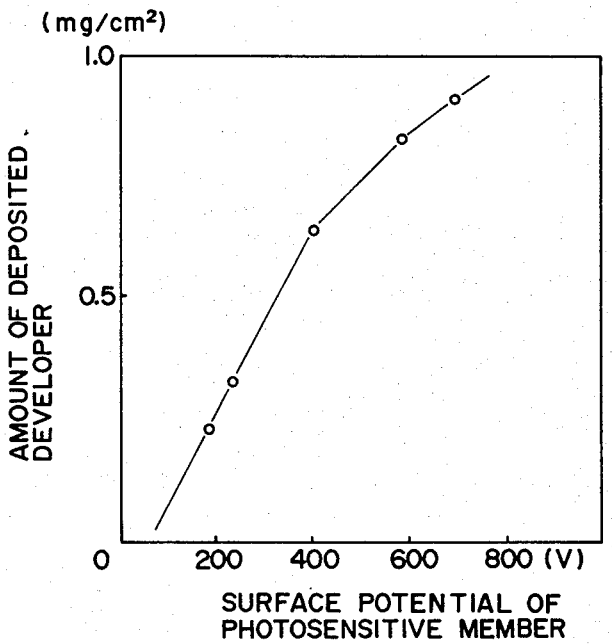
FIG. 3 is a graph showing the relationship between the amount of deposited developer and the surface potential of a photosensitive member in the reproducing machine shown in FIG. 1.
Figure 4:
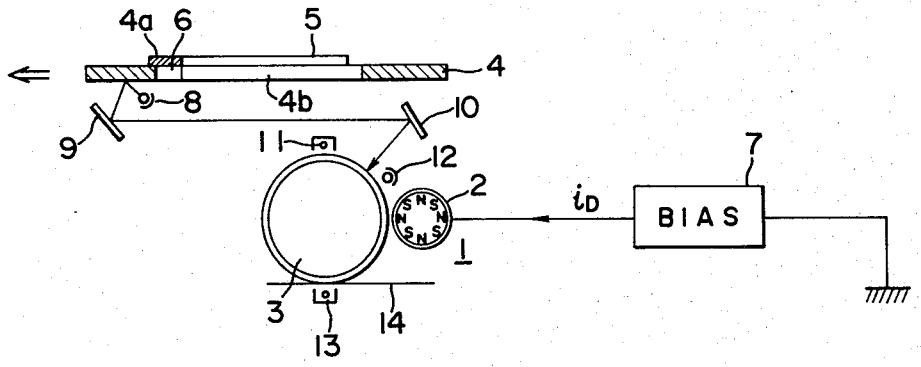
FIG. 4 is a schematic side elevational view of a reproducing machine in accordance with an embodiment of the invention.

In the reproducing machine of the invention shown in FIG. 4, a white leading projecting portion 6, which provides the same projection intensity as the white blank of the document to the photosensitive member 3 is provided at a position which is projected in advance of the document 5, in contact with the document mounting position on a document glass plate 4. A biasing voltage controlling circuit 7 applies to the sleeve 2 a biasing voltage which is selected to substantially nullify the developing current $i_D$ when the electrostatic latent image formed as a result of projection of the leading projecting portion 6 passes a developing device 1. This biasing voltage is held until the electrostatic latent image formed as a result of projection of the subsequent document 5 completely passes the developing device. Therefore, the developer does not attach at all to the portion of the electrostatic latent image corresponding to the white blank portion of the document 5 because the electrostatic latent image of such a portion is maintained at the same potential as that of the image corresponding to the leading projecting portion 6. Consequently, the fog of the reproduced image is completely avoided. The setting of the biasing voltage is made at each cycle of projecting operation, so that the fogging is stably eliminated regardless of the fatigue after the continuous reproduction or the change in the ambient air temperature.

A reference numeral **4*a* designates a member for locating the leading end of the document. The aforementioned leading projecting portion 6 is disposed beneath the member 4*a* in contact with the mounting glass portion 4*b* of the document glass plate 4**.

When the reproducing machine is of the reflecting projection type as illustrated, the leading projecting portion 6 may be a blank document paper which is pinched between the leading end locating member **4*a* and the surface of the document mounting glass. By so doing, it is possible to obtain a reproduced image having no fog even when the document paper has a certain color, simply by replacing the leading projecting portion 6** with the colored document paper.

A reference numeral 8 denotes an exposure lamp, 9, 10 denote projecting mirrors, 11 denotes a charging electrode, 12 denotes a charge eliminating lamp, 13 denotes a transfer electrode and 14 denotes a transfer sheet.

Figure 5:
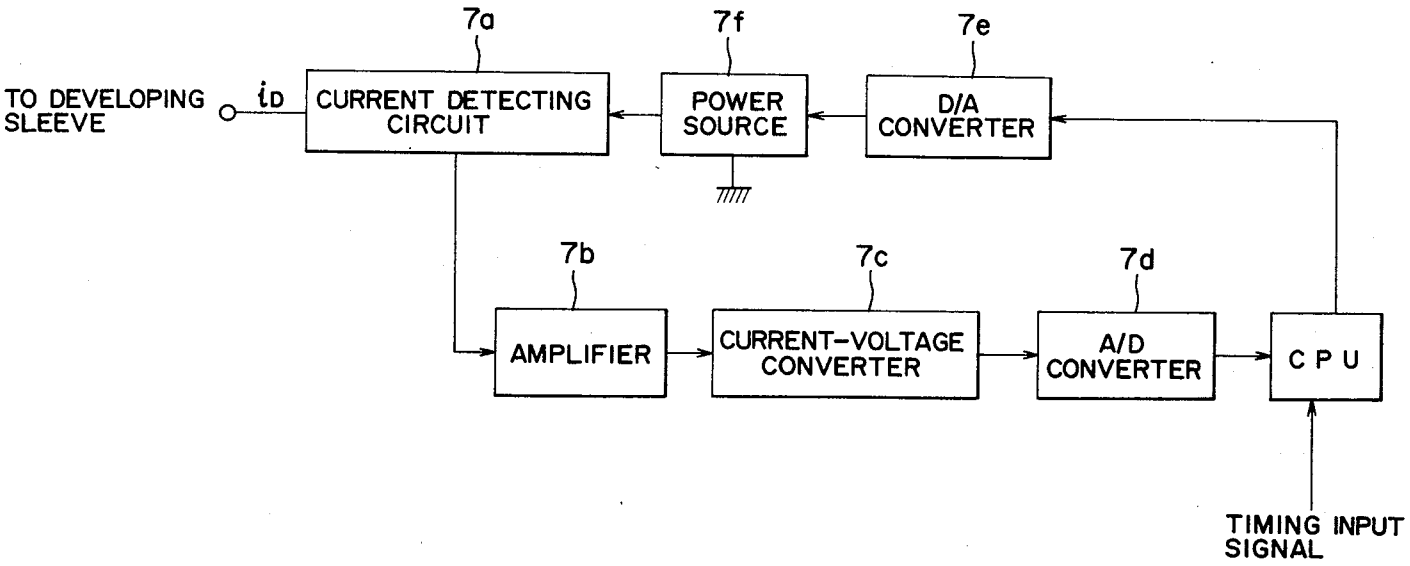
FIG. 5 is a block diagram of a biasing voltage controlling circuit.

The biasing voltage controlling circuit has a construction as shown in FIG. 5. A signal from an encoder etc. showing the rotary position of the drum or a detection signal showing the position of document glass plate is applied as a timing input signal to a central processing unit CPU.

When the leading projecting portion 6 is reached to the developing portion in advance to the document, the potential of developing sleeve is brought to zero or a predetermined potential by the output of CPU. (It may be possible to change the potential when the drum starts to rotate).

The current detected by a current detecting circuit *7a* is amplified by an amplifier *7b* and then converted into a voltage signal by a current voltage converter *7c*. The voltage signal is converted into a digital information by an A/D converter *7d* and applied on the CPU. The CPU generates an output signal such as to nullify the detecting current from the current detecting circuit. This output signal is then converted into an analogue information by a D/A converter *7e*, which in turn controls the output voltage of a power source *7f*.

After the CPU judges such that the detecting current from the current detecting circuit *7a* becomes zero, the output voltage of the power source *7f*, namely, the bias voltage at this state is held. The holding is continued until the document region of the photosensitive drum passes the developing portion or a portion corresponding to the trailing end of the transfer paper passes the developing portion.

Figure 6:
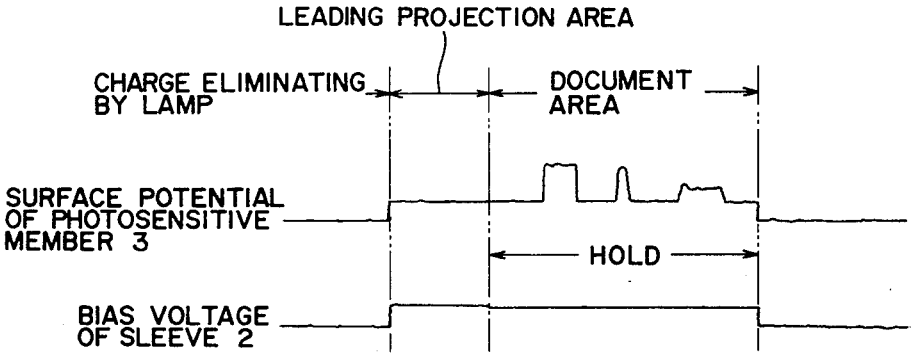
FIG. 6 is a time chart showing the relationship between the surface potential of the photosensitive member and the sleeve bias voltage.

In consequence, the surface potential of the photosensitive member 3 and the biasing voltage applied to the sleeve 2 are changed in relation to time in a manner as shown in FIG. 6.

The present invention is applicable to both of the reproducing machines of movable document table type and movable optical system type. It is to be noted also that the invention does not exclude such a case that, when the document has a specific leading area having no image therein, the leading area is used as the leading projecting portion. Further, the present invention is applicable to both of the developing method in which the conductive toner is used and the developing method in which the insulated toner is used. As the former method, both of one-component developing method and two-component developing method can be used.

Generally, in case that a conductive toner of the resistivity value lower than $10^{10}\Omega$ cm is used, it is possible to develop even if the surface potential of the photosensitive member is low, but the fog is liable to occur. The method of the present invention is effective to prevent the generation of such fog.

In case that an insulated toner or a toner of high resistivity value higher than $10^{10}\Omega$ cm is used, the generation of fog can be prevented positively and a visible image of excellent quality can be obtained by using the method of the present invention.

Said resistivity value of the toner is measured by the following method.

A vessel having an area of 0.50 $cm^2$ and a bottom electrode is filled with a toner of a volume of 1 $cm^3$. After tapping the toner a pressure of 1 $Kg/cm^2$ is applied on the toner. The resistance value of the toner is obtained by reading the value of current passing through the toner when such a voltage is applied between the upper surface of the toner and the bottom electrode that an electric field of 1000 V/cm is generated on the toner.

What is claimed is:

1. In an electrophotographic reproducing machine in which an electrostatic latent image is formed by projecting a document image on the surface of an electrophotographic photosensitive member, and the electrostatic latent image is developed by supplying the surface of said photosensitive member with developer by a developer carrying means capable of being applied with a biasing voltage, the improvement characterized in that the biasing voltage applied to said developer carrying means is set at such a level as to substantially nullify the developing current which flows between said developer carrying means and said surface of photosensitive member when the portion of said surface of said photosensitive member applied with the light corresponding to a white blank of document is developed.

2. An electrophotographic reproducing machine according to claim 1, wherein said developer is conductive developer.

3. An electrophotographic reproducing machine according to claim 2, wherein the setting of the bias voltage is in accordance with an electrostatic latent image formed as a result of the projection of a leading projecting portion provided on a document glass plate in contact with the document mounting position, the projection of said leading projecting portion being made in advance of the projection of the image on the document to form said electrostatic latent image of a potential substantially equal to that corresponding to the white blank portion of said document.

4. An electrophotographic reproducing machine according to claim 1, wherein said developer is insulated developer.

5. An electrophotographic reproducing machine according to claim 4, wherein the setting of the bias voltage is in accordance with an electrostatic latent image formed as a result of the projection of a leading projecting portion provided on a document glass plate in contact with the document mounting position, the projection of said leading projecting portion being made in advance of the projection of the image on the document to form said electrostatic latent image of a potential substantially equal to that corresponding to the white blank portion of said document.

6. An electrophotographic reproducing machine according to claim 1, wherein the setting of the bias voltage is made in accordance with an electrostatic latent image formed as a result of the projection of a leading projecting portion provided on a document glass plate in contact with the document mounting position, the projection of said leading projecting portion being made in advance of the projection of the image on the document to form said electrostatic latent image of a potential substantially equal to that corresponding to the white blank portion of said document.

7. In an electrophotographic reproducing machine in which an electrostatic latent image is formed by projecting a document image on the surface of an electrophotographic photosensitive member, and the electrostatic latent image is developed by supplying the surface of said photosensitive member with developer by a developer carrying means capable of being applied with a biasing voltage, the improvement characterized in that the biasing voltage applied to said developer carrying means is set at such a level as to substantially nullify the developing current which flows from said developer carrying means to said surface of photosensitive member when the portion of said surface of said photosensitive member applied with the light corresponding to a blank of the document is developed.

* * * * *